US005245349A

United States Patent [19]

Harada

[11] Patent Number: 5,245,349

[45] Date of Patent: Sep. 14, 1993

[54] FLAT-PLATE PATCH ANTENNA

[75] Inventor: Takuji Harada, Kanagawa, Japan

[73] Assignee: Harada Kogyo Kabushiki Kaisha, Tokyo, Japan

[21] Appl. No.: 455,618

[22] Filed: Dec. 22, 1989

[51] Int. Cl.[5] ..... H01Q 1/38; H01Q 19/00

[52] U.S. Cl. ..... 343/700 MS; 343/833; 343/880

[58] Field of Search ..... 343/700 MS, 829, 846, 343/833, 880

[56] References Cited

U.S. PATENT DOCUMENTS 2,423,150 7/1947 Lindenblad ..... 343/833
2,509,283 5/1950 Wolf ..... 343/833
4,724,443 2/1988 Nysen ..... 343/700 MS
4,749,996 6/1988 Tresselt ..... 343/700 MS

FOREIGN PATENT DOCUMENTS 160103 12/1981 Japan ..... 343/700 MS
81705 5/1982 Japan ..... 343/700 MS

*Primary Examiner*—Michael C. Wimer
*Attorney, Agent, or Firm*—Koda & Androlia

[57] ABSTRACT

A flat-plate patch antenna including a ground plate, a radiating element provided on the ground plate with a feeder cable connected thereto, and a wave guide element provided to face the radiating element with a space in between, the wave guide element being movable parallel to the ground plate.

2 Claims, 2 Drawing Sheets

FLAT-PLATE PATCH ANTENNA

BACKGROUND OF THE INVENTION

1. Field of the Invention

The present invention relates to a flat-plate patch antenna including a ground plate, a radiating element and a wave guide element.

2. Prior Art

Despite having a simple structure, circular patch antennas are known to have superior directional and high gain characteristics. Specifically, a circular patch antenna can be constructed merely by installing a circular wave guide element in front of a circular radiating element via an insulator or dielectric.

In conventional circular patch antennas, the ground plate, radiating element and wave guide element are constructed as a single unit, so that directionality (or directivity) is superior in the direction of a straight line drawn between the center of the radiating element and the center of the wave guide element.

FIG. 6 is a schematic view of a conventional circular patch antenna.

This antenna includes a ground plate 10*a*, a radiating element 20*a*, and a wave guide element 30*a*. In the Figure, the line La drawn between the center 21*a* of the radiating element 20*a* and the center 31*a* of the wave guide element 30*a* is parallel to the line drawn perpendicular to the ground plate 10*a*. As a result, the directionality is stable with respect to the ground plate 10*a;* and if the ground plate 10*a* is attached to a vertical wall, the directionality of the antenna is fixed in a horizontal direction.

However, this type of antenna has some drawbacks. When the antenna is attached to the wall of a building, it may be impossible to match the directionality of the antenna with the direction of a desired beam. When the ground plate of the antenna is fixed so that it faces a prescribed direction, it may also be impossible to match the directionality of the antenna to the direction of a desired beam. This problem occurs not only in circular patch antennas, but also in flat-plate antennas having other shapes.

SUMMARY OF THE INVENTION

Accordingly, the object of the present invention is to provide a flat-plate antenna in which the directionality of the antenna can be controlled to match the direction of a desired beam when the ground plate of the flat-plate antenna faces in a prescribed direction.

In order to accomplish the object of the present invention, a straight line drawn between the center of the radiating element and the center of the wave guide element is set so that such a line is not parallel to a line drawn perpendicular to the ground plate.

Furthermore, the present invention employs a means for adjusting the angle-of-intersection. This means adjusts the intersecting angle between (a) a straight line drawn between the center of the radiating element and the center of the wave guide element and (b) a line drawn perpendicular to the ground plate.

Since the intersecting angle between (a) a straight line drawn between the center of radiating element and the center of the wave guide element and (b) a line drawn perpendicular to the ground plate is adjustable, the directionality of the antenna can easily be adjusted to match the direction of a desired beam when the ground plate of the antenna is fixed to face in a prescribed direction.

DETAILED DESCRIPTION OF THE INVENTION

Figure 1:
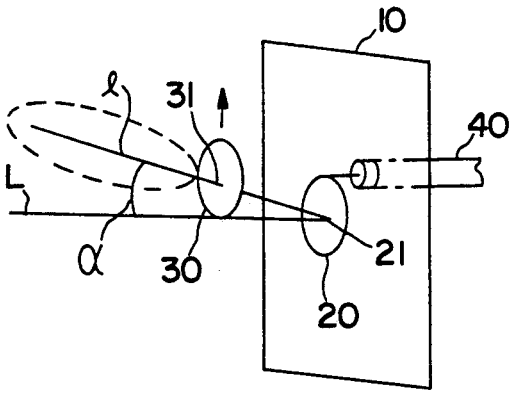
FIGS. 1 and 2 are explanatory diagrams which illustrate principles of the present invention.

FIG. 1 is an explanatory diagram which illustrates the antenna of the present invention.

This antenna comprises a ground plate 10, a radiating element 20 provided on the ground plate 10, and a wave guide element 30 provided so that it faces the radiating element 21 with a space in between. The core conductor of a coaxial cable 40 is connected to the radiating element 20, and the outer skin of the coaxial cable 40 is connected to the ground plate 10.

A straight line l connecting the center 21 of the radiating element 20 and the center 31 of the wave guide element 30 and a line L drawn perpendicular to the ground plate 10 intersect at an angle $\alpha$. This angle $\alpha$ is not zero. In other words, the straight line l connecting the center 21 of the radiating element 20 and the center 31 of the wave guide element 30 is not parallel to the line L drawn perpendicular to the ground plate 10. As a result, the directionality of the circular patch antenna is oriented upward as indicated by the broken line in FIG. 1. The angle $\alpha$ is an arbitrary angle other than zero.

Figure 2:
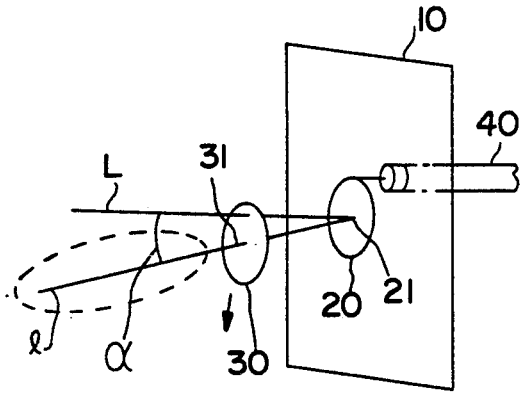

FIG. 2 shows the wave guide element 30 shifted downward. In this Figure, the straight line l connecting the center 21 of the radiating element 20 and the center 31 of the wave guide element 30 is oriented downward with respect to the line L drawn perpendicular to the ground plate 10, so that the angle of intersection between the two lines is $-\alpha$. As a result, the directionality of the circular patch antenna is oriented downward. The angle $-\alpha$ is an arbitrary angle other that zero.

Figure 3:
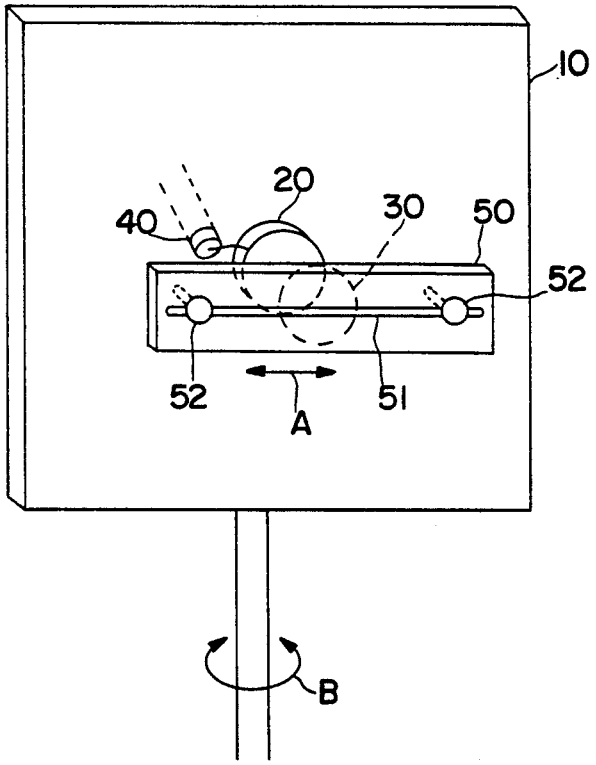
FIG. 3 is a perspective view of one embodiment of the present invention.
Figure 4:
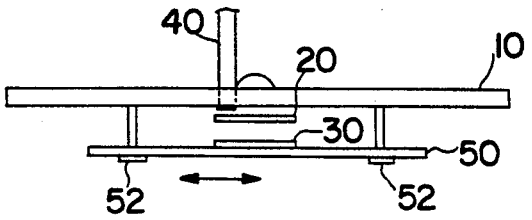
FIG. 4 is a plan view thereof.

FIG. 3 is a perspective view of an antenna to which the principle of the present invention is applied, and FIG. 4 is a plan view thereof.

In the embodiment shown in FIGS. 3 and 4, an acrylic plate is installed between the ground plate 10 and the radiating element 20 (which are both made of aluminum). A sliding plate 50 which slides relative to the ground plate 10 is also installed.

The wave guide element 30 is fixed on the side surface of the sliding plate 50 so that it faces the radiating element 20. A slot 51 is formed in the sliding plate 50, and screws 52 passing through this slot 51 are fastened to the ground plate 10. Thus, the sliding plate 50 is slidably provided on the ground plate 10 by the screws 52.

The sliding plate 50 may be slide to the right and left as indicated by the arrow A in FIG. 3. Thus, the wave guide element 30 fixed on the sliding plate 50 can be shifted to the right and left a prescribed distance relative to both the ground plate 10 and radiating element 20. By shifting the wave guide element 30 along the slot 51, it is possible to swing the directionality of the circular patch antenna to the right or left.

Figure 5:
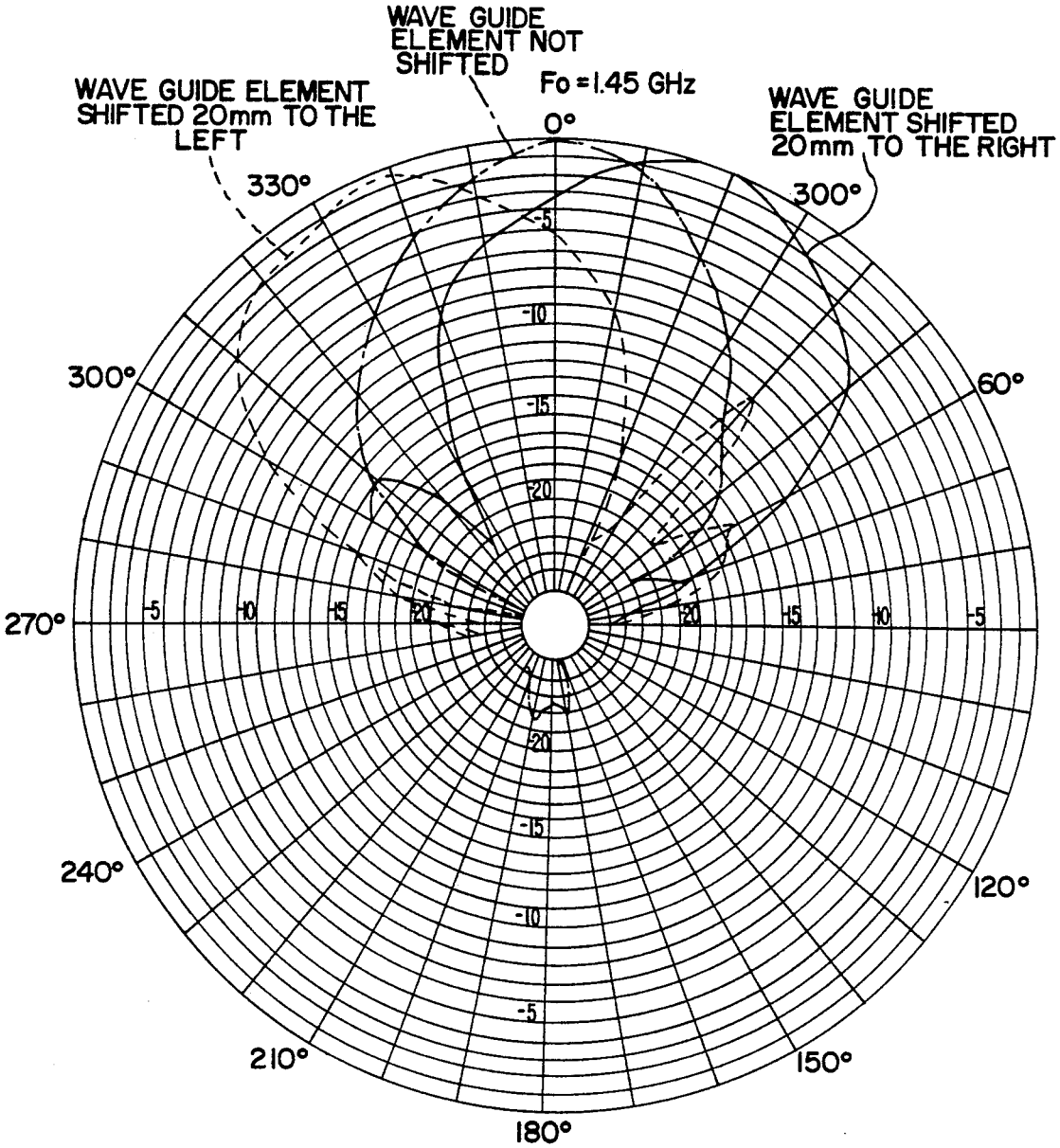
FIG. 5 is a graph which illustrates the test results of the antenna characteristics of this invention.
Figure 6:
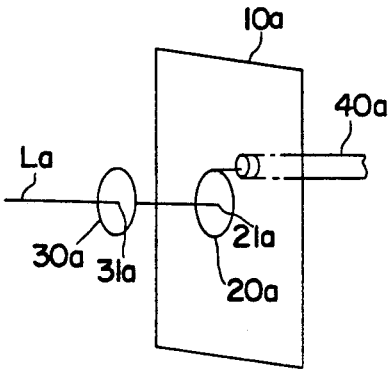
FIG.6 PRIOR ART
FIG. 6 illustrates principle of a conventional antenna.

FIG. 5 is a chart indicating experimental directionality data of the directionality obtained when the wave guide element 30 is shifted 20 mm to the left and right, respectively, or in the embodiment shown in FIGS. 3 and 4.

In this experiment, radio waves of $F_o = 1.45$ GHz were used. A circular plate with the diameter of 1,000 mm was used as the ground plate 10. The diameter of the radiating element 20 was 102 mm, and the diameter of the wave guide element 30 was 92 mm. Two wave guide elements 30 were used. The distance between the ground plate 10 and the radiating element 20 was 7 mm; the distance from the radiating element 20 to the first wave guide element was 7 mm; and the distance from the first wave guide element to the second wave guide element was 26 mm.

FIGS. 3 and 4 show the wave guide elements 30 shifted (slid) only to the right and left. However, it is possible to design so that the wave guide element(s) 30 can be shifted up and down, or so that the wave guide element(s) 30 can be shifted both up and down and to the right and left. It is also possible to design so that the ground plate 10 which has the radiating element 20 and the slidable wave guide element 30 thereon is rotated as a whole as indicated by the arrow B in FIG. 3.

Thus, with the ground plate 10 fixed, the directionality of the antenna can be arbitrarily adjusted in the direction of the wave guide element 30.

In the embodiments, one or two wave guide elements 30 are used. However, it is possible to use three or more wave guide elements. By increasing the number of the wave guide elements, it is possible to further increase the sharpness of the antenna's directionality.

Furthermore, in the embodiments, the sliding plate 50 is employed to shift (move) the wave guide element 30 relative to the radiating element 20 and ground plate 10. However, other mechanisms can be used to shift the wave guide element(s) 30. In other words, any other type of angle-of-intersection adjustment means may be used as long as such means adjusts the angle of intersection between (a) the straight line connecting the center of the radiating element and the center of the wave guide element, and (b) the line drawn perpendicular to the ground plate.

In addition, the embodiments described above illustrate a circular patch antenna in which the radiating element and wave guide element are circular plates. However, the present invention can be applied to a flat-plate patch antenna in which the radiating element 20 and wave guide element 30 have shapes other than a circular shape (e.g., oblong, elliptical, gourd-shaped, etc.). Furthermore, the radiating element 20 and the wave guide element 30 can be a doghnut shape with a central portion of a circular plate omitted.

It is also possible to increase efficiency by cutting out a part of the radiating element and/or a part of the wave guide element where the polarization of the used radio waves is, for example, circular polarization.

As described above, according to the present invention, even in cases where the ground plate of a flat-plate patch antenna is fixed so as to face in a prescribed direction, the directionality of the antenna can easily be matched with the direction of a desired beam.

I claim:

1. A flat-plate patch antenna comprising:

a ground plate;

a circular radiating element provided on said ground plate;

a sliding plate spaced apart from said radiating element and slideable in a direction parallel to said radiating element, said sliding plate further having a longitudinally extending slit provided therein; and a circular waveguide element facing said radiating element and provided on said sliding plate, said waveguide element having a diameter less than a diameter of said radiating element; and wherein a straight line drawn between the center of said radiating element and a center of said waveguide element is not parallel to a straight line drawn perpendicular to said ground plate.

2. A flat-plate patch antenna according to claim 1, further comprising a feeder cable connected to said radiating element.

* * * * *